US010899978B2

(12) United States Patent
Ward et al.

(10) Patent No.: US 10,899,978 B2
(45) Date of Patent: Jan. 26, 2021

(54) METHOD FOR CONVERTING A HIGH-BOILING HYDROCARBON FEEDSTOCK INTO LIGHTER BOILING HYDROCARBON PRODUCTS

(71) Applicants: SAUDI BASIC INDUSTRIES CORPORATION, Riyadh (SA); SABIC GLOBAL TECHNOLOGIES B.V., Bergen op Zoom (NL); Andrew Mark Ward, Stockton-on-Tees (GB); Ravichander Narayanaswamy, Bangalore (IN); Vijayanand Rajagopalan, Bangalore (IN); Lakshmikant Suryakant Powale, Delmar, NY (US); Thomas Hubertus Maria Housmans, Geleen (NL); Arno Johannes Maria Oprins, Maastricht (NL); William Jay Turner, Seabrook, TX (US)

(72) Inventors: Andrew Mark Ward, Stockton-on-Tees (GB); Ravichander Narayanaswamy, Bangalore (IN); Vijayanand Rajagopalan, Bangalore (IN); Lakshmikant Suryakant Powale, Delmar, NY (US); Thomas Hubertus Maria Housmans, Geleen (NL); Arno Johannes Maria Oprins, Maastricht (NL); William Jay Turner, Seabrook, TX (US)

(73) Assignees: SAUDI BASIC INDUSTRIES CORPORATION, Riyadh (SA); SABIC GLOBAL TECHNOLOGIES B.V., Bergen op Zoom (NL)

( * ) Notice: Subject to any disclaimer, the term of this patent is extended or adjusted under 35 U.S.C. 154(b) by 23 days.

(21) Appl. No.: 14/902,135

(22) PCT Filed: Jun. 30, 2014

(86) PCT No.: PCT/EP2014/063853

§ 371 (c)(1),
(2) Date: Dec. 30, 2015

(87) PCT Pub. No.: WO2015/000845

PCT Pub. Date: Jan. 8, 2015

(65) Prior Publication Data

US 2016/0369185 A1 Dec. 22, 2016

(30) Foreign Application Priority Data

Jul. 2, 2013 (EP) ..... 13174774

(51) Int. Cl.
*C10G 69/00* (2006.01)
*C10G 65/12* (2006.01)
(Continued)

(52) U.S. Cl.
CPC ..... *C10G 69/00* (2013.01); *C10G 65/00* (2013.01); *C10G 65/10* (2013.01); *C10G 65/12* (2013.01);
(Continued)

(58) Field of Classification Search
CPC ..... C10G 65/00; C10G 65/10; C10G 65/12; C10G 69/00; C10G 69/04; C10G 69/06;
(Continued)

(56) References Cited

U.S. PATENT DOCUMENTS 3,409,538 A * 11/1968 Gleim ..... C10G 65/00 208/108
3,660,270 A 5/1972 Mason
(Continued)

FOREIGN PATENT DOCUMENTS

EP 0192059 A1 8/1986
FR 2364879 A1 4/1978
(Continued)

OTHER PUBLICATIONS

F. Morel, S. Kressmann, V. Harle, S. Kasztelan, Processes and Catalysts for Hydrocracking of Heavy Oil and Residues, Hydrotreatment and hydrocracking of oil fractions (1997 Elsevier) (Year: 1997).*
(Continued)

*Primary Examiner* — Prem C Singh
*Assistant Examiner* — Brandi M Doyle
(74) *Attorney, Agent, or Firm* — Norton Rose Fulbright US LLP

(57) ABSTRACT

The present invention relates to a process for converting a high-boiling hydrocarbon feedstock into lighter boiling hydrocarbon products, said lighter boiling hydrocarbon products being suitable as a feedstock for petrochemicals
(Continued)

processes, said converting process comprising the following steps of: feeding a hydrocarbon feedstock having a boiling point of >350 deg Celsius to a cascade of hydrocracking unit(s), feeding the bottom stream of a hydrocracking unit as a feedstock for a subsequent hydrocracking unit, wherein the process conditions in each hydrocracking unit(s) are different from each other, in which the hydrocracking conditions from the first to the subsequent hydrocracking unit(s) increase from least severe to most severe, and processing the lighter boiling hydrocarbon products from each hydrocracking unit(s) as a feedstock for one or more petrochemicals processes.

8 Claims, 2 Drawing Sheets

(51) Int. Cl.
*C10G 65/10* (2006.01)
*C10G 69/06* (2006.01)
*C10G 65/00* (2006.01)

(52) U.S. Cl.
CPC ..... *C10G 69/06* (2013.01); *C10G 2300/1011* (2013.01); *C10G 2400/20* (2013.01); *C10G 2400/30* (2013.01)

(58) Field of Classification Search
CPC ..... C10G 69/08; C10G 69/10; C10G 69/123; C10G 2300/1011; C10G 2400/20; C10G 2400/30
See application file for complete search history.

(56) References Cited

U.S. PATENT DOCUMENTS

| | | | | |
|---|---|---|---|---|
| 3,842,138 | A | 10/1974 | Chahvekilian et al. | |
| 3,891,539 | A | 6/1975 | Nelson et al. | |
| 4,137,147 | A * | 1/1979 | Franck | B01J 29/20 208/61 |
| 4,181,601 | A * | 1/1980 | Sze | B01J 23/85 208/143 |
| 4,827,072 | A | 5/1989 | Imai et al. | |
| 4,926,005 | A * | 5/1990 | Olbrich | C07C 5/3335 585/632 |
| 4,954,241 | A * | 9/1990 | Kukes | C10G 65/10 208/111.15 |
| 6,153,087 | A | 11/2000 | Bigeard et al. | |
| 6,270,654 | B1 | 8/2001 | Colyar et al. | |
| 6,454,932 | B1 * | 9/2002 | Baldassari | C10G 65/10 208/153 |
| 7,214,308 | B2 | 5/2007 | Colyar | |
| 7,622,623 | B2 | 11/2009 | Fridman et al. | |
| 7,704,377 | B2 | 4/2010 | Duddy et al. | |
| 7,938,952 | B2 | 5/2011 | Colyar et al. | |
| 8,926,824 | B2 | 1/2015 | Morel | |
| 9,005,430 | B2 | 4/2015 | Fournier et al. | |
| 9,840,674 | B2 | 12/2017 | Weiss et al. | |
| 2006/0287561 | A1 * | 12/2006 | Choi | C10G 57/00 585/324 |
| 2008/0093261 | A1 | 4/2008 | Powers | |
| 2008/0093262 | A1 | 4/2008 | Gragnani et al. | |
| 2009/0050523 | A1 | 2/2009 | Halsey | |
| 2010/0140138 | A1 | 6/2010 | Chaumonnot et al. | 208/119 |
| 2012/0103866 | A1 | 5/2012 | Biswas et al. | 208/49 |
| 2012/0125812 | A1 | 5/2012 | Bridges et al. | |
| 2012/0125813 | A1 | 5/2012 | Bridges et al. | |
| 2012/0205285 | A1 | 8/2012 | Dindi et al. | |
| 2013/0075304 | A1 * | 3/2013 | Chang | C10G 47/06 208/79 |
| 2014/0221709 | A1 * | 8/2014 | Baldassari | C10G 67/049 585/251 |
| 2014/0299515 | A1 | 10/2014 | Weiss et al. | |
| 2015/0329790 | A1 * | 11/2015 | Yang | C10G 65/10 208/59 |
| 2016/0122666 | A1 | 5/2016 | Weiss et al. | |

FOREIGN PATENT DOCUMENTS

| | | |
|---|---|---|
| GB | 1020595 A | 2/1966 |
| GB | 2107732 | 5/1983 |
| GB | 2152082 A | 1/1986 |
| WO | WO 2016/146326 | 9/2016 |

OTHER PUBLICATIONS

Office Action issued in European Application No. 14733661, dated Feb. 10, 2017.
Alfke et al. (2007) Oil Refining, Ullmann's Encyclopedia of Industrial Chemistry.
F. Rase, Handbook of Commercial Catalysts: Heterogeneous Catalysts; CRC Press (2000) pp. 338-347.
International Search Report for International Application No. PCT/EP2014/063853; International Filing Date: Jun. 30, 2014; dated Sep. 18, 2014; 5 Pages.
Machine Translation of FR2364879; Date of Publication: Apr. 14, 1978; 26 Pages.
Speight (2005) Petroleum Refinery Process, Kirk-Othmer Encyclopedia of Chemical Technology.
Written Opinion of the International Searching Authority for International Application No. PCT/EP2014/063853; International Filing Date: Jun. 30, 2014; dated Sep. 18, 2014; 6 Pages.

* cited by examiner

METHOD FOR CONVERTING A HIGH-BOILING HYDROCARBON FEEDSTOCK INTO LIGHTER BOILING HYDROCARBON PRODUCTS

CROSS REFERENCE TO RELATED APPLICATIONS

This application is a 371 of International Application No. PCT/EP2014/063853, filed Jun. 30, 2014, which claims priority to European Application No. 13174774.3, filed Jul. 2, 2013 which are incorporated herein by reference in their entirety.

The present invention relates to a process for converting a high-boiling hydrocarbon feedstock into lighter boiling hydrocarbon products. More in detail, the present invention relates to a process for converting hydrocarbons boiling in the range of >350 deg Celsius into lighter boiling hydrocracked hydrocarbons of the type C2 to a boiling range <350 deg Celsius.

Conventionally, crude oil is processed, via distillation, into a number of cuts such as naphtha, gas oils and residua. Each of these cuts has a number of potential uses such as for producing transportation fuels such as gasoline, diesel and kerosene or as feeds to some petrochemicals and other processing units.

Light crude oil cuts such a naphtha's and some gas oils can be used for producing light olefins and single ring aromatic compounds via processes such as steam cracking in which the hydrocarbon feed stream is evaporated and diluted with steam then exposed to a very high temperature (800° C. to 860° C.) in short residence time (<1 second) furnace (reactor) tubes. In such a process the hydrocarbon molecules in the feed are transformed into (on average) shorter molecules and molecules with lower hydrogen to carbon ratios (such as olefins) when compared to the feed molecules. This process also generates hydrogen as a useful by-product and significant quantities of lower value co-products such as methane and C9+ Aromatics and condensed aromatic species (containing two or more aromatic rings which share edges).

Typically, the heavier (or higher boiling point) aromatic species, such as residua are further processed in a crude oil refinery to maximize the yields of lighter (distillable) products from the crude oil. This processing can be carried out by processes such as hydro-cracking (whereby the hydrocracker feed is exposed to a suitable catalyst under conditions which result in some fraction of the feed molecules being broken into shorter hydrocarbon molecules with the simultaneous addition of hydrogen). Heavy refinery stream hydrocracking is typically carried out at high pressures and temperatures and thus has a high capital cost.

An aspect of such a combination of crude oil distillation and steam cracking of the lighter distillation cuts is the capital and other costs associated with the fractional distillation of crude oil. Heavier crude oil cuts (i.e. those boiling beyond ~350° C.) are relatively rich in substituted aromatic species and especially substituted condensed aromatic species (containing two or more aromatic rings which share edges) and under steam cracking conditions these materials yield substantial quantities of heavy by products such as C9+ aromatics and condensed aromatics. Hence, a consequence of the conventional combination of crude oil distillation and steam cracking is that a substantial fraction of the crude oil, for example 50% by weight, is not processed via the steam cracker as the cracking yield of valuable products from heavier cuts is not considered to be sufficiently high.

Another aspect of the technology discussed above is that even when only light crude oil cuts (such as naphtha) are processed via steam cracking a significant fraction of the feed stream is converted into low value heavy by-products such as C9+ aromatics and condensed aromatics. With typical naphtha's and gas oils these heavy by-products might constitute 5 to 10% of the total product yield (need to double check this and reference it). Whilst this represents a significant financial downgrade of expensive naphtha in lower value material on the scale of a conventional steam cracker the yield of these heavy by-products to does not typically justify the capital investment required to up-grade these materials (e.g. by hydrocracking) into streams that might produce significant quantities of higher value chemicals. This is partly because hydrocracking plants have high capital costs and, as with most petrochemicals processes, the capital cost of these units typically scales with throughput raised to the power of 0.6 or 0.7. Consequently, the capital costs of a small scale hydro-cracking unit are normally considered to be too high to justify such an investment to process steam cracker heavy by-products.

Another aspect of the conventional hydrocracking of heavy refinery streams such as residua is that this is typically carried out under compromise conditions are chosen to achieve the desired overall conversion. As the feed streams contain a mixture of species with a range of easiness of cracking this result in some fraction of the distillable products formed by hydrocracking of relatively easily hydrocracked species being further converted under the conditions necessary to hydrocrack species more difficult to hydrocrack. This increases the hydrogen consumption and heat management difficulties associated with the process and also increases the yield of light molecules such as methane at the expense of more valuable species.

A result of such a combination of crude oil distillation and steam cracking of the lighter distillation cuts is that steam cracking furnace tubes are typically unsuitable for the processing of cuts which contain significant quantities of material with a boiling point greater than ~350° C. as it is difficult to ensure complete evaporation of these cuts prior to exposing the mixed hydrocarbon and steam stream to the high temperatures required to promote thermal cracking. If droplets of liquid hydrocarbon are present in the hot sections of cracking tubes coke is rapidly deposited on the tube surface which reduces heat transfer and increases pressure drop and ultimately curtails the operation of the cracking tube necessitating a shut-down of the tube to allow for decoking. Due to this difficulty a significant proportion of the original crude oil cannot be processed into light olefins and aromatic species via a steam cracker.

US 2012/0125813, US 2012/0125812 and US 2012/0125811 relate to a process for cracking a heavy hydrocarbon feed comprising a vaporization step, a distillation step, a coking step, a hydroprocessing step, and a steam cracking step. For example, US 2012/0125813 relates to a process for steam cracking a heavy hydrocarbon feed to produce ethylene, propylene, C4 olefins, pyrolysis gasoline, and other products, wherein steam cracking of hydrocarbons, i.e. a mixture of a hydrocarbon feed such as ethane, propane, naphtha, gas oil, or other hydrocarbon fractions, is a non-catalytic petrochemical process that is widely used to produce olefins such as ethylene, propylene, butenes, butadiene, and aromatics such as benzene, toluene, and xylenes.

US 2009/0050523 relates to the formation of olefins by thermal cracking in a pyrolysis furnace of liquid whole crude oil and/or condensate derived from natural gas in a manner that is integrated with a hydrocracking operation.

US 2008/0093261 relates to the formation of olefins by hydrocarbon thermal cracking in a pyrolysis furnace of liquid whole crude oil and/or condensate derived from natural gas in a manner that is integrated with a crude oil refinery.

U.S. Pat. No. 3,891,539 relates to a hydrocracking process wherein heavy hydrocarbon oil charge is converted into a major portion of gasoline and a minor portion of residual fuel oil which process comprises: a. hydrocracking heavy hydrocarbon oil charge, in a first hydrocracking zone, at a temperature in the range of from about 700 DEG-850 DEGF and at a pressure of from about 500 to about 3,000 psig, in the presence of a sulfur and nitrogen resistant hydrocracking catalyst for conversion of said heavy hydrocarbon oil charge into not more than about 5 percent gasoline fraction, a major portion of gas-oil fraction boiling in the range of 430 DEG-1000 DEGF., and at least about 10 percent residual oil fraction boiling above 1000 DEGF.; b. separating, in a separation zone, the gas-oil fraction from the residual oil fraction; c. recovering at least a portion of said residual fraction as low sulfur heavy fuel oil product; and d. hydrocracking the gas-oil fraction in a second hydrocracking zone with molecular hydrogen at a temperature in the range of about 700 DEGF. to about 780 DEGF. And at a pressure of from about 500 to about 2,500 psig, in the presence of a hydrocracking catalyst to produce gasoline boiling in the range of 55 DEG-430 DEGF.

U.S. Pat. No. 3,660,270 relates to process for producing gasoline which comprises hydrocracking a petroleum distillate in a first conversion zone, separating the effluent into three fractions, hydrocracking and dehydrogenating the second fraction having a initial boiling point between 180° and 280° F. in a second conversion zone at a temperature in the range of 825° to 950° F. and a pressure of from 0 to 1500 psig.

U.S. Pat. No. 4,137,147 (corresponding to FR 2 364 879) relates to a selective process for producing light olefinic hydrocarbons chiefly those with 2 and 3 carbon atoms respectively per molecule, particularly ethylene and propylene, which are obtained by hydrogenolysis or hydrocracking followed with steam-cracking.

U.S. Pat. No. 3,842,138 relates to a method of thermal cracking in the presence of hydrogen of a charge of hydrocarbons of petroleum wherein the hydrocracking process is carried out under a pressure of 5 and 70 bars at the outlet of the reactor with very short residence times of 0.01 and 0.5 second and a temperature range at the outlet of the reactor extending from 625 to 1000° C.

GB 1020595 relates to a process for the production of naphthalene and benzene which comprises (1) passing a feedstock, containing alkyl-substituted aromatic hydrocarbons boiling within the range 200-600° F. and comprising both alkyl benzenes and alkyl naphthalenes into a first hydrocracker at a temperature from 800 to 1100° F. and a pressure from 150 to 1000 p.s i g, or in the absence of a catalyst at a temperature from 1000 to 1100° F. and a pressure from 150 to 1000 p s i g, (2) subjecting the cracked product to hydrocracking in a second hydrocracker either in the presence of a catalyst at a temperature from 900 to 1200° F. and a pressure from 150 to 1000 p s i g, or in the absence of a catalyst at a temperature from 1100 to 1800° F. and a pressure from 50 to 2500 p.s i g, to give a product enriched with naphthalene and benzene, (3) separating the enriched product into at least a naphthalene-rich fraction (N) and a fraction (B) 70 containing benzene and alkyl benzenes, (4) recovering naphthalene from the naphthalene rich fraction (N) and fractionating (B) to give benzene and a fraction enriched in alkyl benzenes some or all of which is recycled to the second hydrocracker.

US 2012205285 relates to a process for hydroprocessing a hydrocarbon feed, which comprises (a) contacting the feed with (i) a diluent and (ii) hydrogen, to produce a feed/diluent/hydrogen mixture, wherein the hydrogen is dissolved in the mixture to provide a liquid feed; (b) contacting the feed/diluent/hydrogen mixture with a first catalyst in a first treatment zone to produce a first product effluent; (c) contacting the first product effluent with a second catalyst in selective ring-opening zone, to produce a second product effluent; and (d) recycling a portion of the second product effluent as a recycle product stream for use in the diluent in step. An object of the present invention is to provide a method for converting a high-boiling hydrocarbon feedstock into lighter boiling hydrocarbon products.

Another object of the present invention is to provide a method for producing light boiling hydrocarbon products which can be used as a feedstock for further chemical processing.

The present invention relates to process for converting a high-boiling hydrocarbon feedstock into lighter boiling hydrocarbon products, said lighter boiling hydrocarbon products being suitable as a feedstock for petrochemicals processes, said converting process comprising the following steps of:

feeding a hydrocarbon feedstock having a boiling point of >350 deg Celsius to a cascade of hydrocracking unit(s), feeding the bottom stream of a hydrocracking unit as a feedstock for a subsequent hydrocracking unit, wherein the process conditions in each hydrocracking unit(s) are different from each other, in which the hydrocracking conditions from the first to the subsequent hydrocracking unit(s) increase from least severe to most severe, processing the lighter boiling hydrocarbon products from each hydrocracking unit(s) as a feedstock for one or more petrochemicals processes.

On basis of such a process one or more of the presents objects are achieved. The term "from least severe to most severe" relates to the conditions that are needed to hydrocrack the molecules in the subsequent hydrocracking unit(s). As mentioned before, the feedstock for each subsequent hydrocracking unit(s) comprises more and more molecules which are more difficult to hydrocrack resulting in the application of conditions in a hydrocracking unit that are more severe than in the hydrocracking unit(s) located up stream.

The present inventors found that a hydrocarbon feedstock having a boiling point of >350 deg Celsius are fed to a series (or cascade) of hydrocracking process reactors with a range of (increasingly severe) operating conditions/catalysts chosen to maximize the yield of desired products from this material, that is material suitable for production of petrochemicals like light olefins. In fact the lighter boiling hydrocarbon products thus produced can be characterized as hydrocracked hydrocarbon products having a boiling point <350 deg Celsius and at least 2 C atoms. In other words, the intended products according to the invention comprise C2 to <350° C. boiling range hydro-cracking products.

After each step of hydrocracking according to the present method the remaining heavy material is separated from the lighter products and only the heavier materials are fed to the next, more severe, stage of hydrocracking whilst lighter material is separated and thus not exposed to further hydrocracking. In a preferred embodiment each step of the hydrocracking cascade is optimized (via chosen operating conditions, catalyst type and reactor design) such that the ultimate yield of desired products, that is C2 up to boiling <350 deg Celsius, is maximized and capital and associating operating costs are minimized. According to an embodiment this may involve a series of dissimilar processes such as first as fixed bed hydrocracker, followed by an ebullated bed hydrocracker followed by a slurry hydrocracker.

In an embodiment crude oil is directly fed to a series of hydrocracking process reactors in which the hydrocracking conditions from the first to the subsequent hydrocracking unit(s) increase from least severe to most severe. In another embodiment crude oil is first sent to a fractional distillation unit and the heavy (C9+) products from the distillation unit are fed to a series of hydrocracking process reactors in which the hydrocracking conditions from the first to the subsequent hydrocracking unit(s) increase from least severe to most severe. According to another embodiment, the series of hydrocracking unit(s) may be preceded by one or more hydrotreating unit(s).

According to a preferred embodiment the hydrocarbon feedstock having a boiling point of >350 deg Celsius originates as a bottom stream from a crude oil distillation. Other types of feedstocks that can be processed according to the present method include tar sand oil, shale oil and bio based materials, or a combination thereof.

In the present method it is also possible to feed one or more hydrocracking unit(s) with a "fresh" feedstock, i.e. a feedstock that does not originates from the prior hydrocracking unit(s).

Examples of preferred petrochemicals processes FCC (Fluid Catalytic Cracking), SC (Steam Cracking), dehydrogenation units, alkylation units, isomerization units and reforming units, or combinations thereof.

In an embodiment of the present invention the top streams from all hydrocracking units are combined and processed as a feedstock for one or more petrochemicals processes.

In addition, the top streams thus collected are separated into individual streams by a distillation process, wherein the individual streams thus separated are each sent to individual petrochemicals processes.

The present process further comprises separating the lighter boiling hydrocarbon products into (i) a first stream containing the unused hydrogen, possible H2S, NH3, H2O and methane and (ii) a second stream comprising C2 and C2+ products with boiling points below 350° C. According to another embodiment said (ii) second stream is further separated in individual streams of C2/C3/C4 etc., in which the streams thus separated can be used for different petrochemical processes.

In an embodiment of the present invention (ii) second stream is processed as a feedstock for one or more petrochemicals processes. And it is preferred to recycle (i) first stream to a hydrocracking unit, especially the previous hydrocracking unit in the cascade of hydrocracking units. When recycling such a (i) first stream it is preferred to have a purge stream to prevent accumulation of unwanted components in the hydrocracking unit concerned. In such a preferred embodiment the unused hydrogen containing stream from each step in the cascade is fed, as part of the hydrogen requirement, to the previous step in the cascade. In this way fresh hydrogen would be fed to the final step in the cascade and each preceding step would receive a combination of unused hydrogen from the following step plus sufficient fresh hydrogen to meet the specific hydrogen demand of that hydrocracking step. This will reduce the operating cost of the cascade hydrocracker by helping to minimize the loss of valuable hydrogen in any purges. This construction will help to reduce the capital cost of the overall cascade hydrocracker as each individual processing step might be simplified by reducing or eliminating the need for a specific hydrogen purge to maintain the required hydrogen purity at each step in the cascade. it may be especially convenient to arrange the hydrocracking steps in ascending order of operating pressure such that there will be no need to recompress the hydrogen containing stream being fed (counter current with respect to the hydrocarbon flow) from one hydrocracking step to the previous one. This latter point depends on the method used to separate the hydrogen containing stream from the heavy stream, that is the C2-350° C. product material, as some separation methods may include the depressurization of this stream.

In a specific embodiment the cascade of hydrocracking units comprises at least two hydrocracking units, wherein the temperature in the first hydrocracking unit is preferably lower than the temperature in the second hydrocracking unit.

In the process of the present invention the cascade of hydrocracking units preferably comprises at least three hydrocracking units, wherein the first hydrocracking unit is preceded by a hydrotreating unit, wherein the bottom stream of said hydrotreating unit is used as a feedstock for said first hydrocracking unit. As mentioned before, a feedstock from another process unit or a feedstock from a different type like tar sands and shale oil can also be used as a feedstock for each hydrocracking unit.

In such a construction the temperature prevailing in said hydrotreating unit is preferably higher than in said first hydrocracking unit. In addition, it is preferred that the temperature in the cascade of hydrocracking units increases, wherein the temperature prevailing in said third hydrocracking unit is higher than in said first hydrotreating unit.

The present inventors found that for optimum hydrocracking conditions in the cascade of hydrocracking units the particle size of the catalyst present in the cascade of hydrocracking units preferably decreases from the first hydrocracking unit to the subsequent hydrocracking unit(s).

The reactor type design of the hydrocracking unit(s) is chosen from the group of the fixed bed type, ebullated bed reactor type and the slurry phase type. The reactor type design of said first hydrocracking unit is preferably of the fixed bed type. The reactor type design of said second hydrocracking unit is preferably of the ebullated bed reactor type. The reactor type design of said third hydrocracking unit is preferably of the slurry phase type.

According to a preferred embodiment of the process according to the present invention the bottom stream of the final hydrocracking unit is recycled to the inlet of said final hydrocracking unit.

As mentioned before, the petrochemical process is a preferably a steam cracking unit or a dehydrogenation unit. In such a steam cracking unit the reaction products thus generated are separated into a stream containing hydrogen and C4 or lower hydrocarbons, a stream containing C5+ hydrocarbons, and optionally further separating pyrolysis gasolines and a C9+ hydrocarbon-containing fraction from the stream containing the C5+ hydrocarbons. In a preferred embodiment the C9+ hydrocarbon-containing fraction can be used as a feedstock for the present cascade of hydrogenation units.

The present invention further relates to the use of the gaseous light fraction of a multi stage hydrocracked hydrocarbon feedstock as a feedstock for a steam cracking unit.

According to a preferred embodiment there is the use of a fixed bed hydrocracker as the first stage in a cascade with a hydrotreater and three stages of hydrocracking. If, in a preferred embodiment, only two stages of hydrocracking are used, even with or without a hydrotreater, the use of an ebullated bed as the first stage of hydro-cracking is preferred.

The term "crude oil" as used herein refers to the petroleum extracted from geologic formations in its unrefined form. Any crude oil is suitable as the source material for the process of this invention, including Arabian Heavy, Arabian Light, other Gulf crudes, Brent, North Sea crudes, North and West African crudes, Indonesian, Chinese crudes and mixtures thereof, but also shale oil, tar sands and bio-based oils. The crude oil is preferably conventional petroleum having an API gravity of more than 20° API as measured by the ASTM D287 standard. More preferably, the crude oil used is a light crude oil having an API gravity of more than 30° API. Most preferably, the crude oil comprises Arabian Light Crude Oil. Arabian Light Crude Oil typically has an API gravity of between 32-36° API and a sulfur content of between 1.5-4.5 wt-%.

The term "petrochemicals" or "petrochemical products" as used herein relates to chemical products derived from crude oil that are not used as fuels. Petrochemical products include olefins and aromatics that are used as a basic feedstock for producing chemicals and polymers. High-value petrochemicals include olefins and aromatics. Typical high-value olefins include, but are not limited to, ethylene, propylene, butadiene, butylene-1, isobutylene, isoprene, cyclopentadiene and styrene. Typical high-value aromatics include, but are not limited to, benzene, toluene, xylene and ethyl benzene.

The term "fuels" as used herein relates to crude oil-derived products used as energy carrier. Unlike petrochemicals, which are a collection of well-defined compounds, fuels typically are complex mixtures of different hydrocarbon compounds. Fuels commonly produced by oil refineries include, but are not limited to, gasoline, jet fuel, diesel fuel, heavy fuel oil and petroleum coke.

The term "gases produced by the crude distillation unit" or "gases fraction" as used herein refers to the fraction obtained in a crude oil distillation process that is gaseous at ambient temperatures. Accordingly, the "gases fraction" derived by crude distillation mainly comprises C1-C4 hydrocarbons and may further comprise impurities such as hydrogen sulfide and carbon dioxide. In this specification, other petroleum fractions obtained by crude oil distillation are referred to as "naphtha", "kerosene", "gasoil" and "resid". The terms naphtha, kerosene, gasoil and resid are used herein having their generally accepted meaning in the field of petroleum refinery processes; see Alfke et al. (2007) Oil Refining, Ullmann's Encyclopedia of Industrial Chemistry and Speight (2005) Petroleum Refinery Processes, Kirk-Othmer Encyclopedia of Chemical Technology. In this respect, it is to be noted that there may be overlap between the different crude oil distillation fractions due to the complex mixture of the hydrocarbon compounds comprised in the crude oil and the technical limits to the crude oil distillation process. Preferably, the term "naphtha" as used herein relates to the petroleum fraction obtained by crude oil distillation having a boiling point range of about 20-200° C., more preferably of about 30-190° C. Preferably, light naphtha is the fraction having a boiling point range of about 20-100° C., more preferably of about 30-90° C. Heavy naphtha preferably has a boiling point range of about 80-200° C., more preferably of about 90-190° C. Preferably, the term "kerosene" as used herein relates to the petroleum fraction obtained by crude oil distillation having a boiling point range of about 180-270° C., more preferably of about 190-260° C. Preferably, the term "gasoil" as used herein relates to the petroleum fraction obtained by crude oil distillation having a boiling point range of about 250-360° C., more preferably of about 260-350° C. Preferably, the term "resid" as used herein relates to the petroleum fraction obtained by crude oil distillation having a boiling point of more than about 340° C., more preferably of more than about 350° C.

The term "aromatic hydrocarbons" or "aromatics" is very well known in the art. Accordingly, the term "aromatic hydrocarbon" relates to cyclically conjugated hydrocarbon with a stability (due to delocalization) that is significantly greater than that of a hypothetical localized structure (e.g. Kekulé structure). The most common method for determining aromaticity of a given hydrocarbon is the observation of diatropicity in the 1H NMR spectrum, for example the presence of chemical shifts in the range of from 7.2 to 7.3 ppm for benzene ring protons.

The terms "naphthenic hydrocarbons" or "naphthenes" or "cycloalkanes" is used herein having its established meaning and accordingly relates types of alkanes that have one or more rings of carbon atoms in the chemical structure of their molecules.

The term "olefin" is used herein having its well-established meaning. Accordingly, olefin relates to an unsaturated hydrocarbon compound containing at least one carbon-carbon double bond. Preferably, the term "olefins" relates to a mixture comprising two or more of ethylene, propylene, butadiene, butylene-1, isobutylene, isoprene and cyclopentadiene.

The term "LPG" as used herein refers to the well-established acronym for the term "liquefied petroleum gas". LPG generally consists of a blend of C2-C4 hydrocarbons i.e. a mixture of C2, C3, and C4 hydrocarbons.

The term "BTX" as used herein relates to a mixture of benzene, toluene and xylenes.

As used herein, the term "C # hydrocarbons", wherein "#" is a positive integer, is meant to describe all hydrocarbons having # carbon atoms. Moreover, the term "C #+ hydrocarbons" is meant to describe all hydrocarbon molecules having # or more carbon atoms. Accordingly, the term "C5+ hydrocarbons" is meant to describe a mixture of hydrocarbons having 5 or more carbon atoms. The term "C5+ alkanes" accordingly relates to alkanes having 5 or more carbon atoms. As used herein, the term "crude distillation unit" or "crude oil distillation unit" relates to the fractionating column that is used to separate crude oil into fractions by fractional distillation; see Alfke et al. (2007) loc.cit. Preferably, the crude oil is processed in an atmospheric distillation unit to separate gas oil and lighter fractions from higher boiling components (atmospheric residuum or "resid"). It is not required to pass the resid to a vacuum distillation unit for further fractionation of the resid, and it is possible to process the resid as a single fraction. In case of relatively heavy crude oil feeds, however, it may be advantageous to further fractionate the resid using a vacuum distillation unit to further separate the resid into a vacuum gas oil fraction and vacuum residue fraction. In case vacuum distillation is used, the vacuum gas oil fraction and vacuum residue fraction may be processed separately in the subsequent refinery units. For instance, the vacuum residue fraction may be specifically subjected to solvent deasphalting before further processing.

As used herein, the term "hydrocracker unit" or "hydrocracker" relates to a refinery unit in which a hydrocracking process is performed i.e. a catalytic cracking process assisted by the presence of an elevated partial pressure of hydrogen; see e.g. Alfke et al. (2007) loc.cit. The products of this process are saturated hydrocarbons and, depending on the reaction conditions such as temperature, pressure and space velocity and catalyst activity, aromatic hydrocarbons including BTX. The process conditions used for hydrocracking generally includes a process temperature of 200-600° C., elevated pressures of 0.2-30 MPa, preferably 20 MPa, space velocities between 0.1-10 h-1

Hydrocracking reactions proceed through a bifunctional mechanism which requires a acid function, which provides for the cracking and isomerization and which provides breaking and/or rearrangement of the carbon-carbon bonds comprised in the hydrocarbon compounds comprised in the feed, and a hydrogenation function. Many catalysts used for the hydrocracking process are formed by combining various transition metals, or metal sulfides with the solid support such as alumina, silica, alumina-silica, magnesia and zeolites.

As used herein, the term "resid upgrading unit" relates to a refinery unit suitable for the process of resid upgrading, which is a process for breaking the hydrocarbons comprised in the resid and/or refinery unit-derived heavy-distillate into lower boiling point hydrocarbons; see Alfke et al. (2007) loc.cit. Commercially available technologies include a delayed coker, a fluid coker, a resid FCC, a Flexicoker, a visbreaker or a catalytic hydrovisbreaker. Preferably, the resid upgrading unit may be a coking unit or a resid hydrocracker. A "coking unit" is an oil refinery processing unit that converts resid into LPG, light distillate, middle-distillate, heavy-distillate and petroleum coke. The process thermally cracks the long chain hydrocarbon molecules in the residual oil feed into shorter chain molecules.

A "resid hydrocracker" is an oil refinery processing unit that is suitable for the process of resid hydrocracking, which is a process to convert resid into LPG, light distillate, middle-distillate and heavy-distillate. Resid hydrocracking processes are well known in the art; see e.g. Alfke et al. (2007) loc.cit. Accordingly, 3 basic reactor types are employed in commercial hydrocracking which are a fixed bed (trickle bed) reactor type, an ebullated bed reactor type and slurry (entrained flow) reactor type. Fixed bed resid hydrocracking processes are well-established and are capable of processing contaminated streams such as atmospheric residues and vacuum residues to produce light- and middle-distillate which can be further processed to produce olefins and aromatics. The catalysts used in fixed bed resid hydrocracking processes commonly comprise one or more elements selected from the group consisting of Co, Mo and Ni on a refractory support, typically alumina. In case of highly contaminated feeds, the catalyst in fixed bed resid hydrocracking processes may also be replenished to a certain extend (moving bed). The process conditions commonly comprise a temperature of 350-450° C. and a pressure of 2-20 MPa gauge. Ebullated bed resid hydrocracking processes are also well-established and are inter alia characterized in that the catalyst is continuously replaced allowing the processing of highly contaminated feeds. The catalysts used in ebullated bed resid hydrocracking processes commonly comprise one or more elements selected from the group consisting of Co, Mo and Ni on a refractory support, typically alumina. The small particle size of the catalysts employed effectively increases their activity (c.f. similar formulations in forms suitable for fixed bed applications). These two factors allow ebullated hydrocracking processes to achieve significantly higher yields of light products and higher levels of hydrogen addition when compared to fixed bed hydrocracking units. The process conditions commonly comprise a temperature of 350-450° C. and a pressure of 5-25 MPa gauge. Slurry resid hydrocracking processes represent a combination of thermal cracking and catalytic hydrogenation to achieve high yields of distillable products from highly contaminated resid feeds. In the first liquid stage, thermal cracking and hydrocracking reactions occur simultaneously in the fluidized bed at process conditions that include a temperature of 400-500° C. and a pressure of 15-25 MPa gauge. Resid, hydrogen and catalyst are introduced at the bottom of the reactor and a fluidized bed is formed, the height of which depends on flow rate and desired conversion. In these processes catalyst is continuously replaced to achieve consistent conversion levels through an operating cycle. The catalyst may be an unsupported metal sulfide that is generated in situ within the reactor. In practice the additional costs associated with the ebullated bed and slurry phase reactors are only justified when a high conversion of highly contaminated heavy streams such as vacuum gas oils is required. Under these circumstances the limited conversion of very large molecules and the difficulties associated with catalyst deactivation make fixed bed processes relatively. Accordingly, ebullated bed and slurry reactor types are preferred due to their improved yield of light- and middle-distillate when compared to fixed bed hydrocracking. As used herein, the term "resid upgrading liquid effluent" relates to the product produced by resid upgrading excluding the gaseous products, such as methane and LPG and the heavy distillate produced by resid upgrading. The heavy-distillate produced by resid upgrading is preferably recycled to the resid upgrading unit until extinction. However, it may be necessary to purge a relatively small pitch stream. From the viewpoint of carbon efficiency, a resid hydrocracker is preferred over a coking unit as the latter produces considerable amounts of petroleum coke that cannot be upgraded to high value petrochemical products. From the viewpoint of the hydrogen balance of the integrated process, it may be preferred to select a coking unit over a resid hydrocracker as the latter consumes considerable amounts of hydrogen. Also in view of the capital expenditure and/or the operating costs it may be advantageous to select a coking unit over a resid hydrocracker.

The process of the present invention may require removal of sulfur from certain crude oil fractions to prevent catalyst deactivation in downstream refinery processes, such as catalytic reforming or fluid catalytic cracking. Such a hydrodesulfurization process is performed in a "HDS unit" or "hydrotreater"; see Alfke (2007) loc. cit. Generally, the hydrodesulfurization reaction takes place in a fixed-bed reactor at elevated temperatures of 200-425° C., preferably of 300-400° C. and elevated pressures of 1-20 MPa gauge, preferably 1-13 MPa gauge in the presence of a catalyst comprising elements selected from the group consisting of Ni, Mo, Co, W and Pt, with or without promoters, supported on alumina, wherein the catalyst is in a sulfide form.

As used herein, the term "gas separation unit" relates to the refinery unit that separates different compounds comprised in the gases produced by the crude distillation unit and/or refinery unit-derived gases. Compounds that may be separated to separate streams in the gas separation unit comprise ethane, propane, butanes, hydrogen and fuel gas mainly comprising methane. Any conventional method suitable for the separation of said gases may be employed. Accordingly, the gases may be subjected to multiple compression stages wherein acid gases such as CO2 and H2S may be removed between compression stages. In a following step, the gases produced may be partially condensed over stages of a cascade refrigeration system to about where only the hydrogen remains in the gaseous phase. The different hydrocarbon compounds may subsequently be separated by distillation.

A process for the conversion of alkanes to olefins involves "steam cracking" or "pyrolysis". As used herein, the term "steam cracking" relates to a petrochemical process in which saturated hydrocarbons are broken down into smaller, often unsaturated, hydrocarbons such as ethylene and propylene. In steam cracking gaseous hydrocarbon feeds like ethane, propane and butanes, or mixtures thereof, (gas cracking) or liquid hydrocarbon feeds like naphtha or gasoil (liquid cracking) is diluted with steam and briefly heated in a furnace without the presence of oxygen. Typically, the reaction temperature is 750-900° C., but the reaction is only allowed to take place very briefly, usually with residence times of 50-1000 milliseconds. Preferably, a relatively low process pressure is to be selected of atmospheric up to 175 kPa gauge. Preferably, the hydrocarbon compounds ethane, propane and butanes are separately cracked in accordingly specialized furnaces to ensure cracking at optimal conditions. After the cracking temperature has been reached, the gas is quickly quenched to stop the reaction in a transfer line heat exchanger or inside a quenching header using quench oil. Steam cracking results in the slow deposition of coke, a form of carbon, on the reactor walls. Decoking requires the furnace to be isolated from the process and then a flow of steam or a steam/air mixture is passed through the furnace coils. This converts the hard solid carbon layer to carbon monoxide and carbon dioxide. Once this reaction is complete, the furnace is returned to service. The products produced by steam cracking depend on the composition of the feed, the hydrocarbon to steam ratio and on the cracking temperature and furnace residence time. Light hydrocarbon feeds such as ethane, propane, butane or light naphtha give product streams rich in the lighter polymer grade olefins, including ethylene, propylene, and butadiene. Heavier hydrocarbon (full range and heavy naphtha and gas oil fractions) also give products rich in aromatic hydrocarbons.

To separate the different hydrocarbon compounds produced by steam cracking the cracked gas is subjected to a fractionation unit. Such fractionation units are well known in the art and may comprise a so-called gasoline fractionator where the heavy-distillate ("carbon black oil") and the middle-distillate ("cracked distillate") are separated from the light-distillate and the gases. In the subsequent optional quench tower, most of the light-distillate produced by steam cracking ("pyrolysis gasoline" or "pygas") may be separated from the gases by condensing the light-distillate. Subsequently, the gases may be subjected to multiple compression stages wherein the remainder of the light distillate may be separated from the gases between the compression stages. Also acid gases (CO2 and H2S) may be removed between compression stages. In a following step, the gases produced by pyrolysis may be partially condensed over stages of a cascade refrigeration system to about where only the hydrogen remains in the gaseous phase. The different hydrocarbon compounds may subsequently be separated by simple distillation, wherein the ethylene, propylene and C4 olefins are the most important high-value chemicals produced by steam cracking. The methane produced by steam cracking is generally used as fuel gas, the hydrogen may be separated and recycled to processes that consume hydrogen, such as hydrocracking processes. The acetylene produced by steam cracking preferably is selectively hydrogenated to ethylene. The alkanes comprised in the cracked gas may be recycled to the process for olefins synthesis.

The term "propane dehydrogenation unit" as used herein relates to a petrochemical process unit wherein a propane feedstream is converted into a product comprising propylene and hydrogen. Accordingly, the term "butane dehydrogenation unit" relates to a process unit for converting a butane feedstream into C4 olefins. Together, processes for the dehydrogenation of lower alkanes such as propane and butanes are described as lower alkane dehydrogenation process. Processes for the dehydrogenation of lower alkanes are well-known in the art and include oxidative dehydrogenation processes and non-oxidative dehydrogenation processes. In an oxidative dehydrogenation process, the process heat is provided by partial oxidation of the lower alkane(s) in the feed. In a non-oxidative dehydrogenation process, which is preferred in the context of the present invention, the process heat for the endothermic dehydrogenation reaction is provided by external heat sources such as hot flue gases obtained by burning of fuel gas or steam. In a non-oxidative dehydrogenation process the process conditions generally comprise a temperature of 540-700° C. and an absolute pressure of 25-500 kPa. For instance, the UOP Oleflex process allows for the dehydrogenation of propane to form propylene and of (iso)butane to form (iso)butylene (or mixtures thereof) in the presence of a catalyst containing platinum supported on alumina in a moving bed reactor; see e.g. U.S. Pat. No. 4,827,072. The Uhde STAR process allows for the dehydrogenation of propane to form propylene or of butane to form butylene in the presence of a promoted platinum catalyst supported on a zinc-alumina spinel; see e.g. U.S. 4,926,005. The STAR process has been recently improved by applying the principle of oxydehydrogenation. In a secondary adiabatic zone in the reactor part of the hydrogen from the intermediate product is selectively converted with added oxygen to form water. This shifts the thermodynamic equilibrium to higher conversion and achieves a higher yield. Also the external heat required for the endothermic dehydrogenation reaction is partly supplied by the exothermic hydrogen conversion.

The Lummus Catofin process employs a number of fixed bed reactors operating on a cyclical basis. The catalyst is activated alumina impregnated with 18-20 wt-% chromium; see e.g. EP 0 192 059 A1 and GB 2 162 082 A. The Catofin process has the advantage that it is robust and capable of handling impurities which would poison a platinum catalyst. The products produced by a butane dehydrogenation process depends on the nature of the butane feed and the butane dehydrogenation process used. Also the Catofin process allows for the dehydrogenation of butane to form butylene; see e.g. U.S. Pat. No. 7,622,623.

The present invention will be discussed in the next Examples which example should not be interpreted as limiting the scope of protection.

Figure 1:
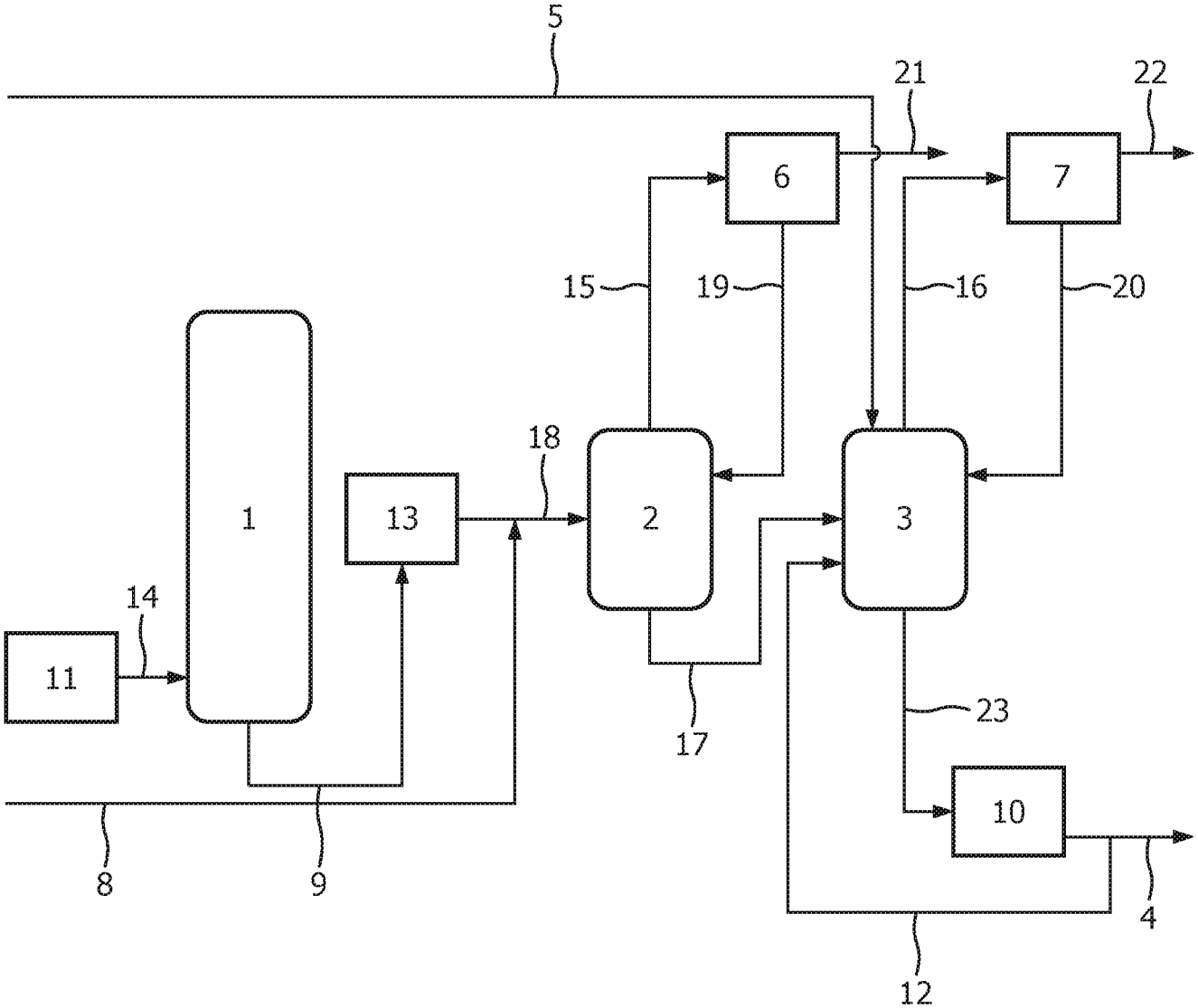
FIG. 1 shows an embodiment of the present invention, comprising a cascade of two hydrotreating units.
Figure 2:
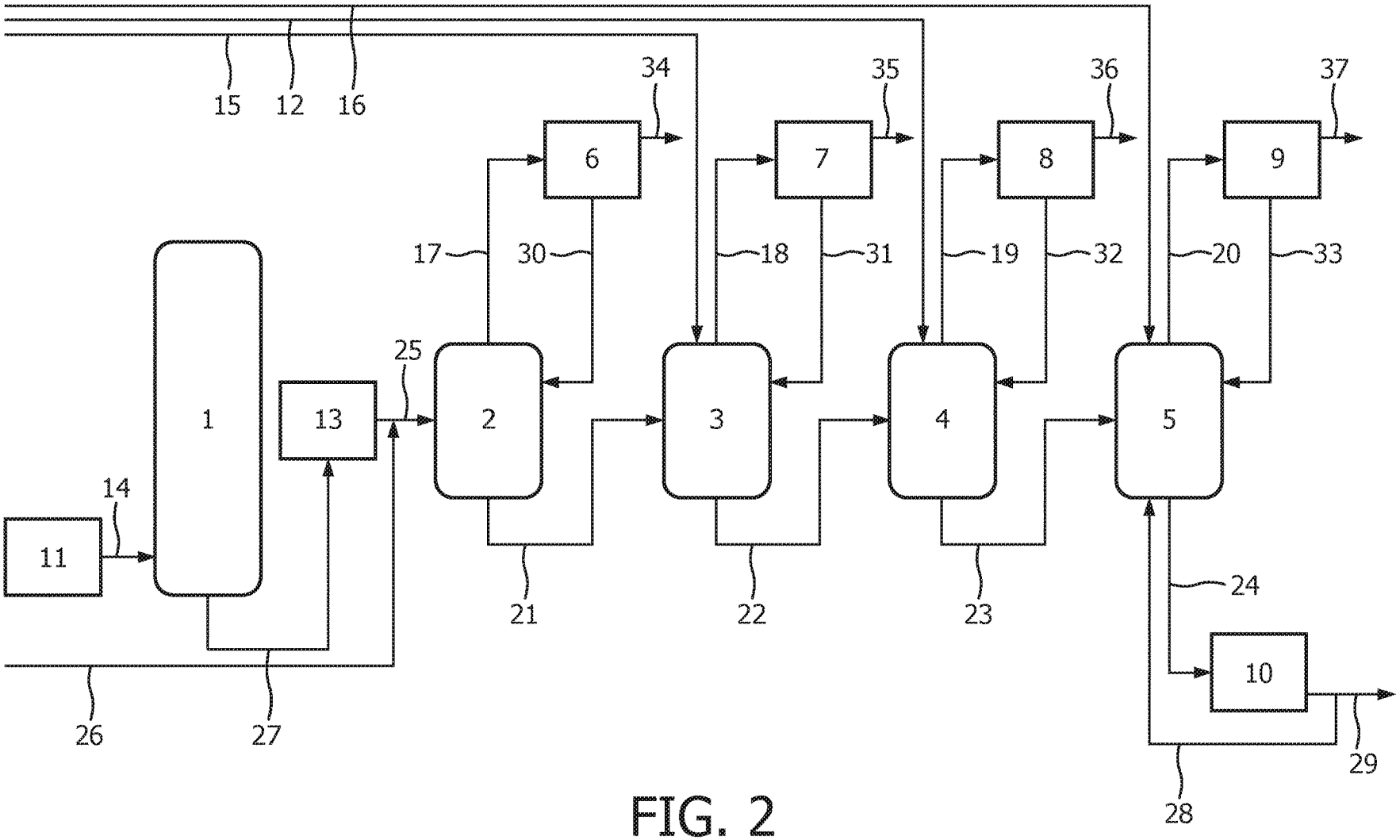
FIG. 2 shows another embodiment of the present invention, comprising a cascade of three hydrotreating units preceded by a hydrotreating unit.

The reference signs in both FIG. 1 and FIG. 2 do not relate with each other.

EXAMPLE 1

The process scheme according to Example 1 can be found in FIG. 1. It is clear for the person skilled in the art that commonly used process equipment like compressors, heat exchangers, pumps, tubing etc. has been omitted due to maintain the legibility of the scheme itself. The process scheme comprises two different stages, i.e. a first hydrocracking stage 2 and a second hydrocracking stage 3.

Crude oil 14 coming from a tank 11 is separated in a separator 1, for example distillation tower, and its heavy fraction 9 having a boiling point of >350 deg Celsius is sent to a cascade of hydrocracking units 2,3. It should be noted that the presence of separator 1 is not a stipulation in terms of processing hydrocarbon feedstock according to the present method.

In the first hydrocracking unit 2 the feedstock 18 is cracked in the presence of hydrogen in a fraction 17 having a boiling point of >350 deg Celsius and a fraction 15 having a boiling point of <350 deg Celsius. Fraction 17 is the feedstock for second hydrocracking unit 3. Fraction 15 is separated in separator 6 into gas stream 19 containing the unused hydrogen together with and H2S, NH3 and H2O together with any methane produced and a stream 21 comprising any C2 or larger hydrocarbon products with boiling points below 350° C., wherein stream 21 can be further separated in specific components, like C2/C3/C4 etc.

In the hydrocracking unit 2 moderate cracking is preferred together with a high degree of hydrogenation to prepare a feed suitable for cracking to extinction in the second step of the hydrocracking cascade. Consequently catalysts incorporating sulphided Ni—W or precious metal hydrogenation functions supported on Al2O3 or Al2O3/Halogen base materials are preferred. The first step might be operated to achieve ~50 to 70% conversion as calculated by the portion of feed material 18 converted into products with boiling points below ~350° C.

Fraction 17 is fed to a second hydrocracker 3 and further cracked in the presence of hydrogen resulting in a fraction 23 having a boiling point of >350 deg Celsius and a fraction 16 having a boiling point of <350 deg Celsius. Fraction 16 is separated in separator 7 in a gas stream 20 containing the unused hydrogen together with and H2S, NH3 and H2O together with any methane produced and a stream 22 comprising any C2 or larger hydrocarbon products with boiling points below 350° C., wherein stream 22 can be further separated in specific components, like C2/C3/C4 etc.

The majority of the metal containing hetero-atomic species present in the feed 17 to the cascade hydrocracker units 2, 3 would be decomposed to hydrocarbon species and the resultant metals would be deposited on the catalyst causing some deactivation. As the sum of the Ni and V metal content in this stream is reasonably low the rate of catalyst deactivation would be low enough to allow practical operating cycles. The operating cycle for this step on the cascade hydrocracker could, however, be extended by allowing for on-stream catalyst replacement e.g. by having two or more parallel reactors operated in a swing mode with periodic catalyst replacement in the off-stream.

The >~350° C. boiling point product stream 17 from the first unit 2 in the cascade would be fed, together with hydrogen (not shown), to the second hydrocracking unit 3. This latter processing step could be carried out in either an ebullated bed or a slurry phase hydrocracker. These types of hydrocracking technologies are preferred as the species present in the feed stream are large molecules which diffuse poorly within the pore structure of catalyst particles and as such catalysts with a high ratio of external to internal area (such as the catalysts suitable for use in ebullated bed and slurry phase hydrocracking reactors) are preferred. In this processing step a high degree of cracking is required to minimize or eliminate the need for a residue recycle or purge stream. For this reason catalysts with relatively high cracking activity such as those using SiO2/Al2O3 and/or acid forms of zeolites are preferred. A moderate level of hydrogenation activity is sufficient for this catalyst hence catalysts containing sulphided Ni—Mo and or sulphided Ni—W would be suitable.

In an embodiment (not shown) stream 21 and stream 22 can be collected and further processed. Stream 21 and 22 can be used as a feedstock for one or more petrochemicals processes.

The residue 23 coming from second hydrocracker unit 3 is sent to a separator 10 and separated into unconverted heavy residue 4 and heavy residue 12, wherein heavy residue 12 is recycled to unit 3. Such a recycle can include a complete recycle or a recycle of some parts.

In a specific embodiment (not shown) stream 20 containing the unused hydrogen together with and H2S, NH3 and H2O together with any methane produced can be sent to a previous hydrocracking unit, that is here unit 2, in stead of to the same unit that is here unit 3.

In a specific embodiment (not shown) the hydrocarbon feed to the hydrocracking 2 comprises not only heavy fraction 9 but other type of feedstock 8 as well. Examples of feedstock 8 are tar sand oil, shale oil and bio based materials. It is also possible to feed feedstock 5 directly into hydrocracking unit 3. The type of feedstock 5 can be tar sand oil, shale oil and bio based materials as well. The conditions in hydrocracking unit 2 and 3 are as follows: suitable operating conditions for the 1st hydrocracking unit 2 would be chosen to achieve a high degree of hydrogenation and a moderate degree of cracking activity. Suitable conditions, in combination with previously mentioned catalyst types, would include: 150 to 300 Barg operating pressure; Start of Run Reactor Temperature between 300° C. and 330° C. and a moderate LHSV of 2-4 hr-1. Suitable operating conditions for the 2nd hydrocracking unit 3 would be chosen to achieve a high degree of cracking activity. Suitable conditions, in combination with previously mentioned catalyst types, would include a reactor temperature between 420 and 450 C, operation pressure between 100 and 200 Barg and an LHSV between 0.1 and 1.5 hr-1.

EXAMPLE 2

The process scheme according to Example 2 can be found in FIG. 2. It is clear for the person skilled in the art that commonly used process equipment like compressors, heat exchangers, pumps, tubing etc. has been omitted due to legibility of the scheme itself. The process scheme comprises four different stages, i.e. a hydrotreating stage 2, a first hydrocracking stage 3, a second hydrocracking stage 4 and a third hydrocracking stage 5.

Hydrotreating Stage

As the residue fraction of crude oil typically contains significant quantities of heteroatom (e.g. sulphur, nitrogen and metals such as nickel and vanadium) containing species, the first stage in the proposed cascade-hydrocracking process is designed to carry out much of the hydro-desulphurisation, hydro-denitrogenation etc. as well as a small amount of hydrocracking (i.e. the breaking of carbon-carbon bonds in association with the addition of hydrogen). The present hydrotreating stage utilizes a combination of sulphided Co/Mo/Al2O3, Ni/W/Al2O3 and Ni/Mo/Al2O3 catalysts (typically as 1.5 to 3 mm diameter cylindrical tablets or extrudates), usually, in fixed bed reactors (trickle bed in residue hydrotreating).

Typical operating conditions used for hydrotreating atmospheric residue (i.e. the crude oil cut boiling above ~350° C.) are reported (Ref. table 18.18 Page 339 of the Handbook of Commercial Catalysts-Heterogeneous Catalysts, Howard F. Rase, CRC Press) to be: Pressure ~150 Barg, Liquid Hourly Space Velocity (LHSV) ~0.25 hr^-1, Start of Run Inlet Temperature ~350° C., Start of Run Exit Temperature ~390° C.

Whilst the non-metal hetero-atoms (S, N, O etc.) are removed as gaseous compounds (e.g. H2S, NH3, H2O respectively) metallic heteroatoms removed from the feed stream are deposited on the catalyst and cause deactivation. For this reason there might be present a system to allow deactivated catalysts to be replaced whilst the plant remains on line. These systems can involve the use of two or more reactors operated in a swing mode (i.e. one reactor is in operation whilst the other reactor is off-line for a catalyst change and when the catalyst in the first reactor becomes sufficiently deactivated the reactors are swapped over). The Axens HYVAL-S process is an example of this type of process. Another technique used to allow the replacement of deactivated catalyst is to continuously or periodically discharge a portion of the catalyst bed from the base of the reactor(s) and add fresh catalyst to the top of the reactor(s). This is achieved by the use of a series of valves on the top and base of the reactor(s).

Although not limiting, crude oil 14 coming from a tank 11 is first separated in a separator 1, for example distillation tower, and its heavy fraction 27 having a boiling point of >350 deg Celsius is sent to a hydrotreating unit 2 and a cascade of hydrocracking units 3, 4, 5. It should be noted that the presence of separator 1 is not a stipulation in terms of processing hydrocarbon feedstock according to the present method. Heavy fraction 27 can be further treated in unit 13, but unit 13 is optional.

In the hydrotreating unit 2 the feed 25 is converted in a lights fraction 17 and a heavy fraction 21 having a boiling point of >350 deg Celsius. In separator 6 fraction 17 is further separated in a recycle gas stream 30 and a gaseous fraction 34 comprising any C2 or larger hydrocarbon products with boiling points below 350° C., wherein stream 34 can be further separated in specific components, like C2/C3/C4 etc. The heavy fraction 21 is sent to the first hydrocracking unit 3.

First Hydrocracking Stage

The reactor effluent 21 from the hydrotreating step 2 in the cascade is passed directly to the first hydrocracking unit 3. In the first hydrocracking unit 3 the reaction products stream 18 is sent to a separator 7 (e.g. flash distillation vessel) which splits the reaction products stream 18 into (i) a gas stream 31 containing the unused hydrogen together with and H2S, NH3 and H2O together with any methane produced and (ii) a stream 35 comprising any C2 or larger hydrocarbon products with boiling points below 350° C. The heavy fraction stream 22 comprising any material boiling above 350° C. is used as a feedstock for the subsequent hydrocracking unit 4. The purpose of the first step in the hydrocracking cascade is to break down a portion of the >350° C. boiling range the molecules into smaller, lower boiling point materials, that are suitable for feeding to a steam cracker to make olefins, whilst minimizing the production of methane. Useful dual functional catalysts contain components active for carbon-carbon bond scission (cracking) and hydrogenation. It is reported (Ref. Page 347 of the Handbook of Commercial Catalysts—Heterogeneous Catalysts, Howard F. Rase, CRC Press) that a range of catalysts compositions are suitable for use in hydro-cracking including: For the hydrogenation function in order of increasing activity under low-sulphur conditions: sulphided Ni—Mo, sulphided Ni—W, metallic Pd and metallic Pt. For the cracking function Al2O3, Al2O3/halogen, SiO2/Al2O3 and acid forms of zeolites. The selection of the most suitable catalyst type depends on the intended extent of reaction.

In the first hydrocracking reactor of a cascade hydrocracker it would be desirable to select a catalyst with a high degree of hydrogenation activity together with a low to moderate degree of cracking activity (to minimize the extent of methane formation). Such a catalyst might be based on sulphided Ni—W, metallic Pd or metallic Pt together with an Al2O3 or Al2O3/halogen support.

Suitable process conditions for first hydrocracking step in the cascade hydrocracker might be selected to promote a high degree of hydrogenation and only a moderate level of cracking (to minimize methane formation): Suitable operating conditions, therefore might be: 150 to 200 Barg operating pressure; Start of Run Inlet Temperature 280~300° C., Start of Run Exit Temperature 330-350° C. and a moderate LHSV of 2-4 hr-1.

Second Hydrocracking Stage

The reactor effluent 22 from the first hydrocracking unit 3 in the cascade will be sent to a second hydrocracking unit 4. The reaction products stream 19 is passed into a separator 8 which splits the reaction products stream 19 into (i) a gas stream 32 containing the unused hydrogen together with any methane produced in the first hydrocracking step which can largely be recycled to the reactor and (ii) a stream 36 comprising any C2 or larger hydrocarbon products with boiling points below 350° C. The stream 23 comprising any material boiling above 350° C. is used as a feedstock for the third hydrocracking unit 5 the purpose of which would be to break down a portion of the >350° C. boiling range the molecules into smaller, lower boiling point materials, that are suitable for feeding to for example a steam cracker to make olefins, whilst minimizing the production of methane. This feed material contains significant quantities of large molecules and has a high viscosity hence, to ensure good contact between the catalyst and these molecules a small catalyst particle size is desirable together with an ebullated bed reactor design. Processes using small particle sized catalyst (~0.8 mm) with compositions similar to those used for fixed bed hydrocracking processes are preferred. In the second step in the hydrocracking cascade process it may be desirable to select a catalyst with a higher cracking activity than was selected for the first step. Consequently a catalyst using a siO2/Al2O3 or zeolite component may be preferred.

Suitable process conditions for such a processing step would be a reactor temperature between 420 and 450 C, operation pressure between 100 and 200 Barg and an LHSV between 0.1 and 1.5 Hr-1.

Third Hydrocracking Stage

The reactor effluent 23 from the second hydrocracking step in the cascade is sent to a third hydrocracking unit 5. The reaction products stream 20 will be passed into a separator 9 which splits the reaction products stream 20 into (i) a gas stream 33 containing the unused hydrogen together with any methane produced in the previous hydrocracking step which can largely be recycled to the reactor and (ii) a stream 37 comprising any C2 or larger hydrocarbon products with boiling points below 350° C. The stream 24 comprising any material boiling above 350° C. can be fed to another hydrocracking step, or can be used for other purposes.

The residue 24 coming from third hydrocracker unit 5 can also be sent to a separator 10 and separated in purge stream 29 and heavy residue 28, wherein heavy residue 28 is recycled to unit 5. Feed material 23 contains significant quantities of large and very difficult to hydrocrack molecules and has a high viscosity hence, to ensure good contact between the catalyst and these molecules a very small catalyst particle size is desirable together with slurry reactor design.

Suitable catalysts use very small, colloidal or even nano-sized catalyst particles comprised of such materials as MoS2 and have operating temperatures between 440 and 490 C. and operating pressures between 100 and 300 Barg.

The reactor effluent 20 from the third hydrocracking step in the cascade would be passed into a separator 9 which splits the effluent into (i) a gas stream 33 containing the unused hydrogen together with any methane produced which can largely be recycled to the reactor and (ii) and a separate stream 37 comprising any C2 or larger hydrocarbon products with boiling points below 350° C. The stream 24 comprising any material boiling above 350° C. can be further separated in a separator 10, wherein stream 28 can be recycled to the slurry reactor where it can be mixed with the stream passing forward from the second hydrocracking step.

A small purge stream may be utilized to remove the spent catalyst and some small fraction of the heavy (i.e. BP>350 C.) reactor effluent.

In a specific embodiment (not shown) stream 32, 33 containing the unused hydrogen together with and H2S, NH3 and H2O together with any methane produced can be sent to a previous hydrocracking unit, that is here unit 3 for stream 32 and unit 4 for stream 33, respectively.

In a specific embodiment (not shown) the hydrocarbon feed to the hydrocracking unit 3 comprises not only heavy fraction 21 but feedstock 15 as well. Such a construction also holds for unit 4 and 5 with feed 12 and 16, respectively. Examples of feedstock 12, 15, 16 are tar sand oil, shale oil and bio based materials. It is also possible to feed a feedstock 26 directly in hydrotreating unit 2.

The conditions in hydrocracking unit 3, 4 and 5 are comparable to those earlier mentioned.

The particle size of the catalysts present in units 3, 4, 5 decreases in size, that is the particle size of catalyst in unit 5, is smaller than that in unit 3.

For legibility purposes both in FIG. 1 and FIG. 2 the separators 6,7,8,9 have been shown as units separate from the reactor units 2,3,4,5, respectively. However, one can understand that a stream coming from the respective hydrocracking unit is sent to one or more separators for obtaining a stream containing the unused hydrogen together with any methane produced, another stream comprising any C2 or larger hydrocarbon products with boiling points below 350° C. and a stream comprising any material boiling above 350° C. The present method is however not restricted to the specific construction shown in FIG. 1 and FIG. 2.

The invention claimed is:

1. A process for converting a high-boiling hydrocarbon feedstock into lighter boiling hydrocarbon products, said lighter boiling hydrocarbon products being suitable as a feedstock for petrochemicals processes, said process comprising the steps of:

feeding a hydrocarbon feedstock having a boiling point of greater than 350° C. to a hydrotreating unit which yields a bottom stream having a boiling point of greater than 350° C. and consisting essentially of hydrocarbons, wherein the hydrocarbon feedstock consists essentially of hydrocarbons;

feeding the bottom stream from of the hydrotreating unit to a first hydrocracking unit of a cascade of hydrocracking units comprising at least two hydrocracking units under conditions to produce a first hydrocracked bottom stream having a boiling point of greater than 350° C. that consists essentially of hydrocarbons, and a first lighter boiling fraction with a boiling point of less than 350° C., wherein the first hydrocracking unit is a fixed bed reactor;

wherein the catalyst in the first hydrocracking unit comprises at least one member selected from the group consisting of sulphided Ni—W, precious metal hydrogenation functions supported on $Al_2O_3$ or $Al_2O_3$/Halogen base material, and wherein the first hydrocracking step is operated to achieve from 50 to 70% conversion as calculated by the portion of the bottom stream of the hydrotreating unit converted into products with boiling points below 350° C.;

feeding the bottom stream of said first hydrocracking unit to a second hydrocracking unit to produce a second lighter boiling fraction and also a hydrocracked bottom fraction consisting essentially of hydrocarbons and a second lighter boiling fraction, wherein the second hydrocracking unit is an ebullating bed reactor;

wherein the operating pressure for the first hydrocracking stage is 150 to 200 Barg operating pressure and the operating pressure for the second hydrocracking stage is 100 to 200 Barg;

wherein the feedstock of the second hydrocracking unit is heavier than the feedstock of the first hydrocracking unit;

wherein the process conditions in the first hydrocracking unit is less severe than the second hydrocracker;

wherein the temperature prevailing in said hydrotreating unit is higher than in said first hydrocracking unit, wherein the temperature in said hydrotreating unit is in the range 300 to 400° C. and the temperature in said first hydrocracking unit is in the range 280 to 300° C.;

wherein the second lighter boiling fraction comprises C2 to <350° C. boiling range hydro-cracking products;

wherein the temperature in the cascade of hydrocracking units increases from said first hydrocracker unit to said second hydrocracker unit; and processing the fraction with a boiling point of less than 350° C. from the first hydrocracker and the top fraction from the second hydrocracking unit as a feedstock for a petrochemical process;

separating the first and second lighter boiling hydrocarbon fractions into (i) a first stream containing the unused hydrogen, possible $H_2S$, $NH_3$, $H_2O$, and methane and (ii) a second stream comprising C2 and C2+ products with boiling points below 350° C.;

wherein the particle size of the catalyst present decreases from the first hydrocracking unit to the second hydrocracking unit; and wherein the first stream is returned to a hydrocracking unit, wherein the petrochemical process comprises at least one member selected from the group consisting of alkylation units, isomerization units and reforming units, or combinations thereof; and the process includes a third hydrocracking unit downstream from the second hydrocracking unit and wherein the reactor design of the a third hydrocracking unit is chosen from the group of a the fixed bed reactor, an ebullated bead reactor, a slurry reactor and a slurry phase reactor and wherein hydrocracking in the third hydrocracking unit is conducted at 490° C.

2. The process according to claim 1, wherein the temperature in said hydrotreating unit is 300° C. and the temperature in said first hydrocracking unit is 300° C.

3. The process according to claim 1, wherein the temperature in said hydrotreating unit is 400° C. and the temperature in said first hydrocracking unit is 300° C.

4. The process according to claim 1, wherein the temperature in said hydrotreating unit is 400° C.

5. The process according to claim 1, wherein the third hydrocracking unit is an ebullated bed reactor.

6. The process according to claim 1, wherein the hydrocarbon feedstock to at least one of said first hydrocracking unit or said second hydrocracking unit further comprises a heavy stream originating from a steam cracker unit.

7. A process for converting a high-boiling hydrocarbon feedstock into lighter boiling hydrocarbon products, said lighter boiling hydrocarbon products being suitable as a feedstock for petrochemicals processes, said process consisting of the following steps of:

feeding a hydrocarbon feedstock having a boiling point of >350 deg Celsius to a hydrotreater operated at a temperature to produce a hydrotreated bottom stream, wherein the feedstock consists of a bio-based material;

feeding the hydrotreated effluent to a cascade of hydrocracking units comprising at least three hydrocracking units, wherein the bottom stream of said first hydrocracking unit is used as a feedstock for said second hydrocracking unit, the bottom stream of said second hydrocracking unit is used as a feedstock for said third hydrocracking unit, wherein the pressure for the first hydrocracking stage is 150 to 200 Barg operating pressure, the pressure for the second hydrocracking stage is 100 to 200 Barg operating pressure and the pressure for the third hydrocracking stage is 100 to 300 Barg operating pressure, wherein the bottom stream of a hydrocracking unit as a feedstock for a subsequent hydrocracking unit is such that said feedstock for a subsequent hydrocracking unit is heavier than the feedstock of a previous hydrocracking unit in the cascade of hydrocracking units, wherein the process conditions in each hydrocracking unit is different from each other, in which the hydrocracking conditions from the first to the subsequent hydrocracking unit increase from least severe to most severe, wherein the temperature prevailing in said hydrotreating unit is higher than in said first hydrocracking unit, wherein the temperature in said hydrotreating unit is in the range 300 to 400° C. and the temperature in said first hydrocracking unit is in the range 280 to 300° C., wherein the temperature in the cascade of hydrocracking units increases, wherein the temperature prevailing in said third hydrocracking unit is higher than in said hydrotreating unit, wherein the temperature in said third hydrocracking unit consists of 490° C., and processing lighter boiling hydrocarbon products from each hydrocracking units as a feedstock for one or more petrochemicals processes.

8. A process consisting of the steps of:

separating crude oil in a distillation tower to yield a heavy crude fraction the heavy crude fraction having a boiling point greater than 350° C. and a light crude fraction having boiling point of less than 350° C.;

feeding the heavy crude fraction to a hydrotreater which fixed bed reactor containing a hydrotreating catalyst consisting of combination of sulphided $Co/Mo/Al_2O_3$, $Ni/W/Al_2O_3$ and $Ni/Mo/Al_2O_3$ catalysts to hydrotreating the heavy fraction and obtain a first effluent, wherein the catalysts are 1.5 to 3 mm diameter cylindrical tablets or extrudates, and wherein the operating conditions for hydrotreating include a pressure of 150 Barg, a Liquid Hourly Space Velocity (LHSV) of 0.25 $hr^{-1}$, a Start of Run Inlet Temperature of 350° C. and a Start of Run Exit Temperature 390° C.;

directly feeding the first effluent in a separator to obtain a first lights fraction and a first heavy fraction having a boiling point of greater than 350° C.;

separating the first lights fraction into a fraction consisting of C2 hydrocarbons, a fraction consisting of C3 hydrocarbons, and a faction consisting of C4 hydrocarbons;

feeding the first heavy fraction to a first hydrocracker containing a first catalyst consisting of sulphided Ni—W, metallic Pd and metallic Pt on an $Al_2O_3$/halogen support and hydrocracking the heavy fraction to obtain a first hydrocracker products stream and a first hydrocracker residue, wherein operating conditions in the first hydrocracker include a first hydrocracker operating pressure of 150 to 200 Barg; a first hydrocracker Start of Run Inlet Temperature of from 280° C. to 300° C., and a first hydrocracker Start of Run Exit Temperature 330-350° C. and a moderate LHSV of 2-4 $hr^{-1}$;

feeding first products stream to a flash distillation vessel to obtain a gas stream containing unused hydrogen, $H_2S$, $NH_3$, $H_2O$ and methane and a stream comprising C2 or larger hydrocarbons;

feeding the first hydrocracker residue to a second hydrocracker and hydrocracking the first hydrocracking residue to form a second hydrocracker reaction products stream and a second hydrocracker residue stream comprising material boiling over 350° C., wherein the second hydrocracker contains a second catalyst, wherein the second catalyst has a particle size of about 0.8 mm, and wherein the processing conditions in the second hydrocracker include a second hydrocracker reactor temperature between 420 and 450° C., a second hydrocracker operation pressure between 100 and 200 Barg and a second hydrocracker LHSV between 0.1 and 1.5 $Hr^{-1}$;

separating the second reaction products stream to obtain a second gas stream containing unused hydrogen and methane and a second stream comprising C2 or larger hydrocarbon products with boiling points below 350° C.;

feeding the second hydrocracker residue stream to a third hydrocracker comprising a third catalyst, and hydrocracking the second hydrocracker residue stream to obtain a third reaction products stream;

feeding the third products reaction stream to a separator to obtain a third gas stream containing unused hydrogen and methane and a third stream comprising C2 or larger hydrocarbon products with boiling points below 350° C.;

sending residue from the third hydrocracker to a separator to obtain a purge stream and a third hydrocracker heavy residue, and recycling the third hydrocracker heavy residue to the third hydrocracking unit;

wherein the third catalyst consists of nano-sized catalyst particles consisting of $MoS_2$ wherein operating parameters in the third hydrocracking unit include a third hydrocracking temperature of 490° C. and third hydrocracking operating pressure between 100 and 300 Barg.

* * * * *